United States Patent [19]

Livingston

[11] 4,199,200

[45] Apr. 22, 1980

[54] ROLLER BRACKET ASSEMBLY FOR DRAWERS

[75] Inventor: Richard D. Livingston, Rockford, Ill.

[73] Assignee: Amerock Corporation, Rockford, Ill.

[21] Appl. No.: 937,725

[22] Filed: Aug. 29, 1978

[51] Int. Cl.[2] ..... A47B 88/10; F16C 21/00; F16C 29/04

[52] U.S. Cl. ..... 308/3.8; 312/341 R; 312/348

[58] Field of Search ..... 308/3.8, 3.6, 6 R; 312/348, 341 R, 345, 349; 312/333

[56] References Cited

U.S. PATENT DOCUMENTS

| | | | |
|---|---|---|---|
| 1,671,655 | 5/1928 | Schneider | 308/3.8 |
| 3,716,284 | 2/1973 | Vogt | 308/3.6 X |
| 3,980,364 | 9/1976 | Entrikin et al. | 308/3.8 X |

*Primary Examiner*—Douglas C. Butler
*Attorney, Agent, or Firm*—Leydig, Voit, Osann, Mayer & Holt, Ltd.

[57] ABSTRACT

A bracket assembly for supporting rollers to be received in tracks on a drawer includes a vertical wing and a horizontal wing integral with and projecting laterally from the lower edge of the vertical wing. At least two rollers are journaled on the vertical wing with one roller disposed adjacent each end of the vertical wing. A slot is formed transversely in the horizontal wing and a screw coacts with two flanges on the vertical wing, one on each side of the slot, whereby the screw may selectively move the flanges toward and away from each other thereby to change the width of the slot and adjust the relative positions of the rollers.

6 Claims, 7 Drawing Figures

ROLLER BRACKET ASSEMBLY FOR DRAWERS

BACKGROUND OF THE INVENTION

The invention relates to a roller bracket assembly for supporting a drawer for in-and-out sliding in an opening in a cabinet. More particularly, the invention relates to a bracket assembly which includes a vertical wing supporting at least two spaced rollers and adapted to be attached to the frame of the cabinet. A horizontal wing is integral with and projects laterally from the lower edge of the vertical wing. An assembly of this general type is disclosed in Entrikin et al U.S. Pat. No. 3,980,364.

SUMMARY OF THE INVENTION

The general object of the present invention is to provide a new and improved roller bracket assembly which includes means for selectively bending the bracket to adjust the relative positions of the rollers.

A more detailed object is to accomplish the foregoing by providing the horizontal wing with a slot and incorporating means which can selectively adjust the width of the slot thereby to bend the assembly and adjust the position of one roller relative to the other roller.

The invention also resides in the novel means for adjusting the width of the slot.

DETAILED DESCRIPTION OF THE PREFERRED EMBODIMENTS

Figure 1:
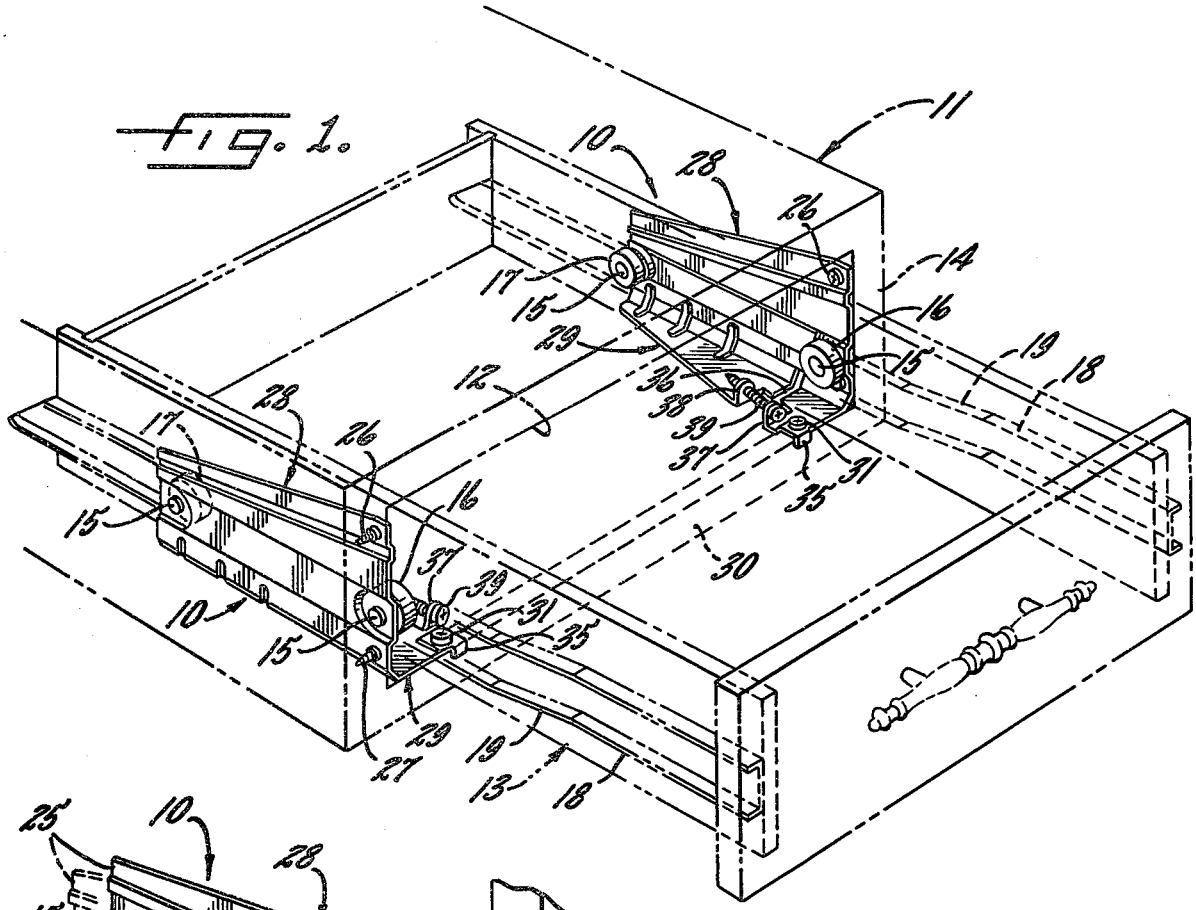
FIG. 1 is a fragmentary perspective view of a cabinet equipped with the new and improved roller bracket assemblies embodying the present invention.
Figure 2:
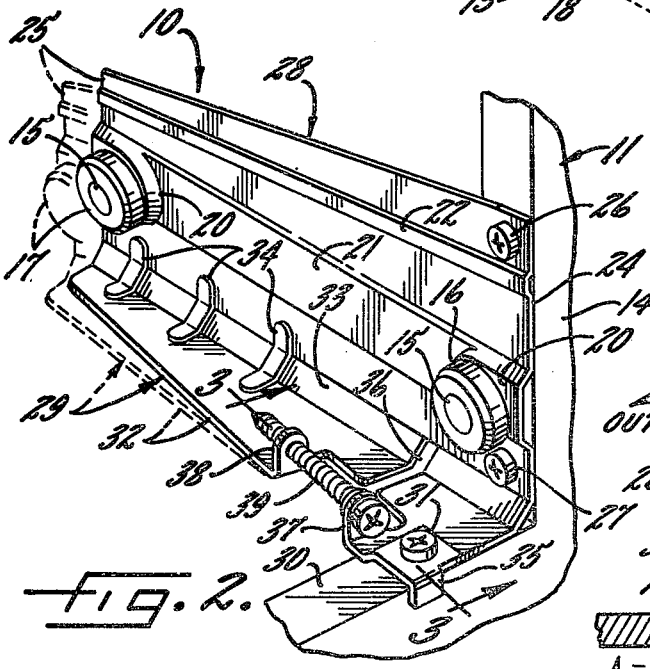
FIG. 2 is a fragmentary perspective view of one of the bracket assemblies.
Figure 4:
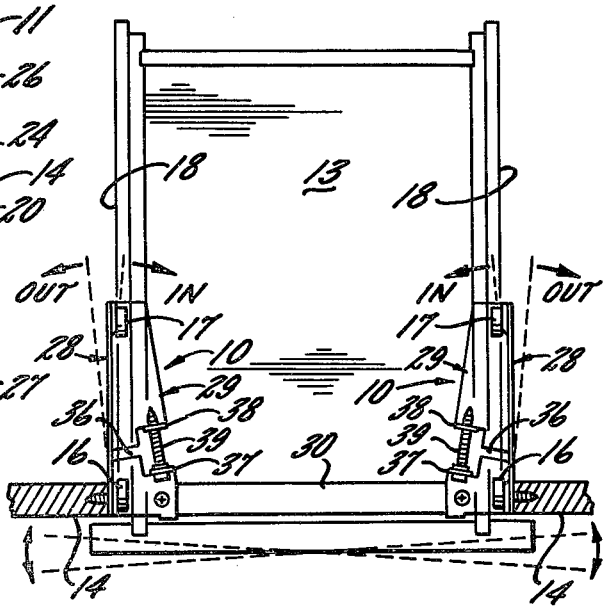
FIG. 4 is a fragmentary plan view of the cabinet on a reduced scale and showing the manner of adjusting the widths of the slots in the horizontal wings of the assemblies.

As shown in the drawings for purposes of illustration, the invention is embodied in a roller bracket assembly 10 adapted to be mounted within a cabinet 11 adjacent an opening 12 therein and serving to support a drawer 13 for in-and-out sliding in the opening. One bracket assembly is located at each side of the opening and, in this instance, the assemblies are attached to the inside edges of the opposed upright members 14 of the cabinet face frame. Secured to each bracket are two horizontally spaced and horizontally extending axles 15 which journal small anti-friction rollers 16 and 17. The latter fit within a channel-like track 18 (see FIG. 1) secured to the side of the drawer and thus support the drawer for relatively friction-free sliding within the cabinet. A dip or so-called "down ramp" 19 is formed intermediate the ends of each track so that, when the drawer is pushed rearwardly into the cabinet a predetermined distance, the down ramps ride across the rollers 16 and enable gravity to close the drawer automatically to a fully shut position. To avoid frictional contact between the track and the bracket assembly during sliding of the drawer, the rollers are supported on raised opposite end portions 20 (FIG. 2) of a rearwardly extending support rib 21 formed along the innerside of the bracket. An additional but narrower support rib 22 extends along the bracket adjacent the upper edge 23 thereof and is slanted downwardly toward the larger rib upon progressing from the forward end 24 toward the rearward end 25 of the bracket. As shown in FIG. 1, each bracket assembly 10 is attached to the vertical face frame member 14 by wood screws 26 and 27.

The bracket assembly includes two generally planar wing members 28 and 29 connected together and extending generally perpendicular to each other, the wing 28 being upright or vertical and the wing 29 being horizontal and projecting laterally from the lower edges of the wing 28. The rollers 16 and 17 are journaled on the upright wing 28 with the screws 26 and 27 fastening the forward portion of the wing 28 to the member 14. The horizontal wing 29 extends inwardly from adjacent the vertical face frame member 28 for connection to a horizontal face frame member 30 by means of a fastener 31. As a result of this construction, a solid three-point connection may be made between the bracket and the face frame of the cabinet so as to keep the rearward end portion of the bracket assembly from shifting laterally within the cabinet and eventually causing the assembly to loosen.

In the present instance, the horizontal wing 29 is a generally triangular member including an inner edge 32 (FIG. 2) slanted outwardly, that is, toward the upright wing 28 upon progressing rearwardly from the forward end portion of the bracket assembly 10. The upright wing is connected integrally with the horizontal wing by way of a slanted intermediate panel 33 extending downwardly and inwardly from the lower edge of the upright wing to the outer edge of the horizontal wing so as to lie within a plane forming a 45 degree angle with respect to vertical. Three spaced support ribs 34 extending across the rearward end portion of the panel and into the vertical and horizontal wings serve to keep the wings from being easily bent out of their normal positions with respect to each other and with respect to the panel. By virtue of this construction, the connection between the two wings is spaced inwardly from the projected corner between the two wings without any loss of strength so as to enable the bracket to be mounted easily on the face frame even within openings 12 having rounded instead of square corners.

Figure 3:
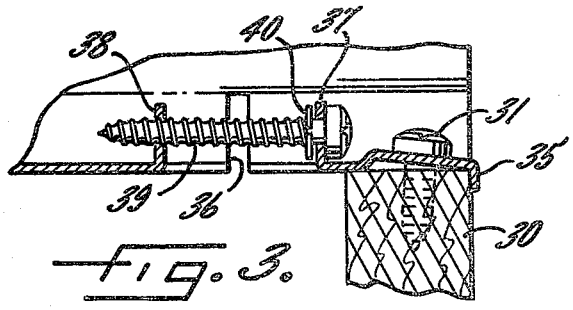
FIG. 3 is a fragmentary sectional view taken along the line 3—3 in FIG. 2.

To keep the rearward end portion of the bracket assembly 10 from swinging outwardly within the cabinet 11, a generally rectangular tab 35 is formed integrally with the forward edge of the horizontal wing 29. The tab projects downwardly from the wing in a substantially perpendicular direction relative thereto so the rearward surface of the tab engages with the front surface of the horizontal face frame member 30 (see FIG. 3). In this way, the forward end portion of the bracket is kept from pivoting rearwardly relative to the vertical member 14 of the face frame and this, in turn, keeps the rearward end portion of the bracket from being moved laterally outward within the cabinet.

Optimum sliding of the track 18 on the rollers 16 and 17 depends upon the rollers being alined with the track. Accordingly, the present invention contemplates a bracket assembly 10 with a novel means for adjusting the position of one roller relative to the other roller to aline the two rollers with the track. This means includes a slot 36 in one of the wings, herein the horizontal wing 29 between the rollers 16 and 17 and a means to vary the width of the slot whereby the bracket assembly is bent laterally one way or the other to place the roller 17 in the desired position relative to the roller 16.

In the embodiment illustrated in FIGS. 1–4, the rollers 16 and 17 are journaled on the upright or vertical wing 28 and the slot 36 is formed in the horizontal wing 29 near the front end of the bracket but behind the roller 16. Upright flanges 37 and 38 are struck up from the horizontal wing 29 on opposite sides of the slot and a screw 39 projects through the flange 37 and a washer 40 (FIG. 3) on the back side of that flange and is threaded into the flange 38. As illustrated by the broken lines and the arrows in FIG. 4, each screw 39 may be turned to pull the flanges 37 and 38 together and move the vertical wing 28 and hence the roller 17 inwardly or the screws may be turned in the opposite direction to bend the vertical wings outwardly with a corresponding movement of the rollers 17.

Figure 5:
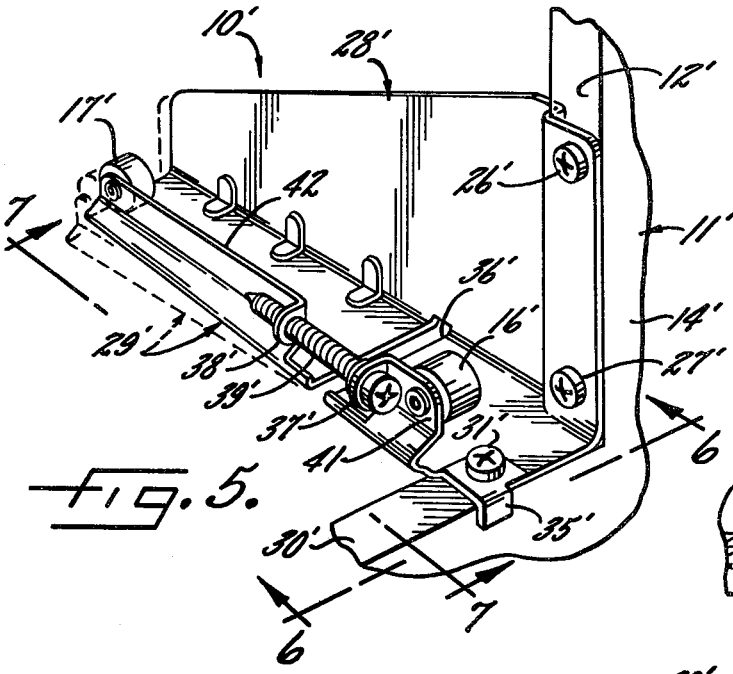
FIG. 5 is a fragmentary perspective view similar to FIG. 2 and illustrates a modified form of the invention.
Figure 6:
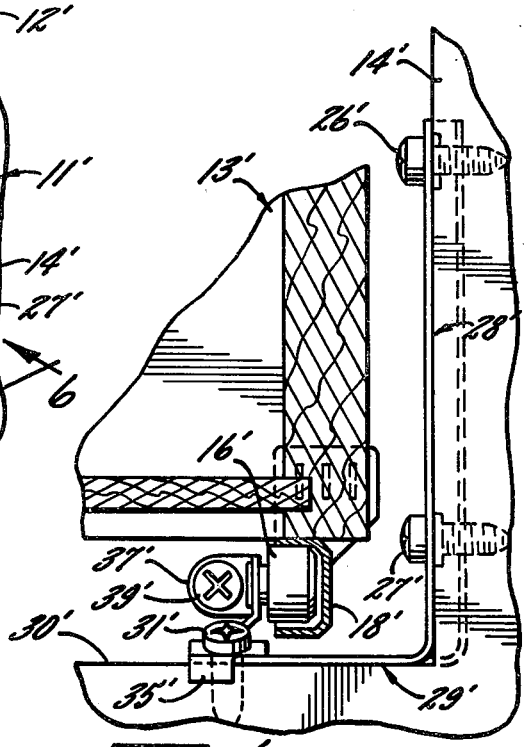
FIG. 6 is a fragmentary sectional view taken along the line 6—6 in FIG. 5.
Figure 7:
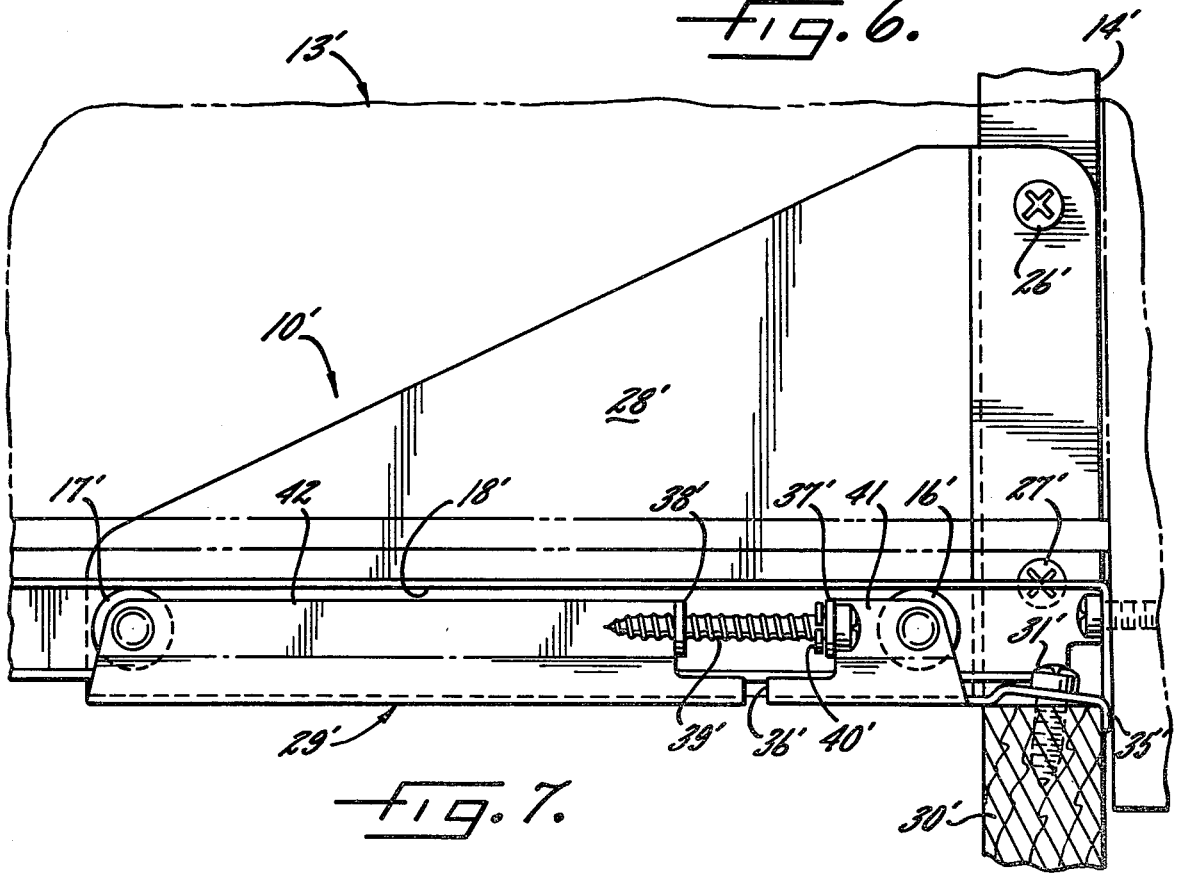
FIG. 7 is a fragmentary sectional view taken along the line 7—7 in FIG. 5.

A modified form of the invention is illustrated in FIGS. 5–7 in which the corresponding parts are indicated by the same but primed reference numbers. In this instance, the rollers 16' and 17' are journaled on longitudinal extensions 41 and 42 of the flanges 37' and 38' on the horizontal wing 29'. As in the form illustrated in FIGS. 1–4, the screw 39' is effective to move the flanges 37' and 38' together or apart thereby changing the width of the slot 36' and repositioning the roller 17' relative to the roller 16'.

I claim:

1. A roller bracket assembly adapted to support a drawer for in and out sliding in an opening in a cabinet, said bracket assembly comprising a vertical wing, a horizontal wing integral with and projecting laterally from the lower edge of said vertical wing, a first roller journaled on one of said wings adjacent one end thereof, a second roller journaled on said one wing adjacent the other end thereof, one of said wings having a transverse slot disposed between said first and second rollers, and means on said one wing connecting said one wing on opposite sides of said slot, said means being selectively operable to increase or decrease the width of said slot and thereby bending said wings adjacent said slot and changing the position of said second roller relative to said first roller.

2. A roller bracket assembly as defined in claim 1 in which said means includes a threaded member and parts on said one wing disposed on opposite sides of said slot, said threaded member being connected to said parts and being selectively operable to move said parts toward and away from each other thereby to change the width of said slot.

3. A roller bracket assembly as defined in claim 1 in which said means includes a first flange integral with said horizontal wing and disposed on one side of said slot, a second flange integral with said horizontal wing and disposed on the other side of said slot, and a screw projecting through one of said flanges and threaded into the other of said flanges whereby said screw may be turned to move said flanges toward and away from each other and thereby change the width of said slot.

4. A roller bracket assembly as defined in claim 3 in which said first roller is journaled on said first flange and said second roller is journaled on said second flange.

5. A roller bracket assembly as defined in claim 1 in which said rollers are journaled on said vertical wing.

6. A roller bracket assembly as defined in claim 1 in which said rollers are journaled on said horizontal wing.

* * * * *